US007360381B1

(12) United States Patent
Leite

(10) Patent No.: US 7,360,381 B1
(45) Date of Patent: Apr. 22, 2008

(54) SECURITY LOCK

(75) Inventor: Paul Leite, Rehoboth, MA (US)

(73) Assignee: Compu-Guard, Inc., Swansea, MA (US)

( * ) Notice: Subject to any disclaimer, the term of this patent is extended or adjusted under 35 U.S.C. 154(b) by 183 days.

(21) Appl. No.: 11/226,147

(22) Filed: Sep. 14, 2005

(51) Int. Cl.
*E05B 13/00* (2006.01)

(52) U.S. Cl. ..... 70/208; 70/210; 70/360; 292/207; 292/336.3

(58) Field of Classification Search ..... 70/208, 70/210, 137, 139, 150, 224, 360, 361, 387, 70/467, 483–485, 471, 489; 292/205–208, 292/336.3, 359, DIG. 31
See application file for complete search history.

(56) References Cited

U.S. PATENT DOCUMENTS

| | | | | |
|---|---|---|---|---|
| 1,281,536 | A * | 10/1918 | Doyle | 70/265 |
| 3,665,737 | A * | 5/1972 | Reese | 70/118 |
| 3,829,139 | A * | 8/1974 | Storlie | 292/349 |
| 4,040,653 | A * | 8/1977 | Takahashi | 292/202 |
| 4,380,915 | A * | 4/1983 | Kincaid et al. | 70/224 |
| 4,492,394 | A * | 1/1985 | Dignan | 292/64 |
| 4,991,414 | A * | 2/1991 | Moore et al. | 70/215 |
| 5,015,019 | A * | 5/1991 | Razdolsky | 292/200 |
| 5,526,660 | A * | 6/1996 | Bennett et al. | 70/208 |
| 5,913,908 | A | 6/1999 | Czipri | |
| 6,178,789 | B1 * | 1/2001 | Finkelstein et al. | 70/210 |
| 6,357,268 | B1 * | 3/2002 | Takimoto | 70/208 |
| 6,418,761 | B1 | 7/2002 | Wytcherley et al. | |
| 6,623,052 | B2 | 9/2003 | Hansen | |
| 2003/0000266 | A1 * | 1/2003 | Molzer | 70/210 |
| 2004/0007031 | A1 * | 1/2004 | Molzer et al. | 70/208 |

* cited by examiner

*Primary Examiner*—Lloyd A. Gall
(74) *Attorney, Agent, or Firm*—Salter & Michaelson

(57) ABSTRACT

A locking device for securing to a door or the like and including a rotatable knob adapted for mounting at a front surface of the door and having locked and unlocked positions, a locking member adapted for positioning at an opposite rear surface of the door and in alignment with the rotatable knob and a key-controlled lock supported at the front surface of the door and having locked and unlocked positions. The locking member includes a locking bar and an integral latch plate having a free end. The locking bar is for engagement with a door striker in the locked position. The key-controlled lock is spacedly disposed from the locking member and adapted for engaging, inside the door, with the free end of the latch plate. The key-controlled lock, in its locked position, engages with the latch plate to prevent rotation of the rotatable knob, and in its unlocked position, disengages from the latch plate to enable rotation of the rotatable knob from its locked position to its unlocked position.

21 Claims, 12 Drawing Sheets

SECURITY LOCK

TECHNICAL FIELD

The present invention relates in general to a security lock and pertains, more particularly, to an improved locking or securing assembly used primarily for engaging a door or a panel with a housing or cabinet.

BACKGROUND OF THE INVENTION

Various types of locking devices are known. These devices are typically used for securing a first member such as a door panel in a closed position relative to a second member such as a housing or cabinet. These locking devices may also be referred to as latches or actuators. Prior art examples of these devices are found in the following U.S. Pat. Nos. 5,913,908 to Czipri; 6,418,761 to Wytcherley et al.; and 6,623,052 to Hansen. Existing locking devices suffer from one or more of the following drawbacks. They are relatively complex in construction, are too expensive to fabricate, difficult to operate and difficult to install.

SUMMARY OF THE INVENTION

Accordingly, it is an object of the present invention to provide an improved security lock that is relatively simple in construction and that is inexpensive to fabricate.

Another object of the present invention is to provide a locking system that includes a separately disposed rotatable knob and a key-operated lock.

In accordance with one embodiment of the present invention there is provided a locking device for securing to a door or the like. The device includes a rotatable knob adapted for mounting at a front surface of the door and having locked and unlocked positions and a locking member adapted for positioning at an opposite rear surface of the door and in alignment with the rotatable knob. The locking member further includes a latch plate integral therewith and means for securing the rotatable knob to the locking member through the door. A key controlled lock is supported at the front surface of the door and has locked and unlocked positions. The key controlled lock is spacedly disposed adjacent the locking member and adapted for engaging, inside the door, with the latch plate. The key controlled lock, in its locked position, engages with the latch plate to prevent rotation of the rotatable knob, and in its unlocked position, disengages from the latch plate to enable rotation of the rotatable knob from its locked position to its unlocked position.

In accordance with other aspects of the present invention there may be provided means for securing the rotatable knob to the locking member including a threaded shaft on the knob engaging with a hole in the locking member; the threaded shaft and the hole may have like non-circular cross-sections and a nut may secure the threaded shaft with the locking member; the locking member may include a locking bar and a transverse leg that interconnects the locking bar and the latch plate; the latch plate may extend from the leg and has a free end that is in alignment with the key controlled lock; the latch plate free end may have a hole that receives a plunger of the key controlled lock when the key controlled lock is in its locked position; the key controlled lock may include a housing having the plunger extending therefrom in the locked position and having the plunger withdrawn from the latch plate hole in the unlocked position; the locking bar may be U-shaped and is adapted to engage a striker plate on the door and the rotatable knob, locking member and key controlled lock are all disposed at a top area of the door and further including a second rotatable knob, second locking member and second key controlled lock at a bottom area of the door.

In accordance with another embodiment of the present invention there is provided a locking assembly for securing the door of a cabinet in either an unlocked or locked position. The locking assembly comprises a rotatable knob; means for mounting the rotatable knob at a front surface of the door; the rotatable knob having locked and unlocked positions; a locking member; and means for positioning the locking member at an opposite rear surface of the door and in alignment with the rotatable knob. The locking member further includes a latch bar and a latch plate integral therewith. Means are provided for securing the rotatable knob to the locking member through the door. A key controlled lock is supported at the front surface of the door and has locked and unlocked positions. The latch plate extends radially from the latch bar so that a free end of the latch plate is in alignment with the key controlled lock. The key controlled lock is spacedly disposed from the rotatable knob and adapted for engaging, inside the door, with the free end of the latch plate. The key controlled lock, in its locked position, engages with the latch plate to prevent rotation of the rotatable knob, and in its unlocked position, disengages from the latch plate to enable rotation of the rotatable knob from its locked position to its unlocked position.

In accordance with still other aspects of the present invention the locking member may include a locking bar and a transverse leg that interconnects the locking bar and the latch plate; the latch plate may extend from the leg and has a free end that is in alignment with the key controlled lock; the latch plate free end may have a hole that receives a plunger of the key controlled lock when the key controlled lock is in its locked position; the means for securing the rotatable knob to the locking member may include a threaded shaft on the knob engaging with a hole in the locking member; the threaded shaft and the hole may have like non-circular cross-sections and a nut secures the threaded shaft with the locking member; the key controlled lock may include a housing having the plunger extending therefrom in the locked position and having the plunger withdrawn from the latch plate hole in the unlocked position; the locking bar may be U-shaped and is adapted to engage a striker plate on the door and the rotatable knob, locking member and key controlled lock are all disposed at a top area of the door and further including a second rotatable knob, second locking member and second key controlled lock at a bottom area of the door.

In accordance with still another embodiment of the present invention there is provided a locking device for securing to a door or the like, and comprising: a rotatable knob adapted for mounting at a front surface of the door and having locked and unlocked positions and a locking member adapted for positioning at an opposite rear surface of the door and in alignment with the rotatable knob. The locking member comprises a locking bar and an integral latch plate having a free end. The locking bar is adapted for engagement with a door striker in the locked position. The rotatable knob is coupled to the locking member through the door. A key controlled lock is supported at the front surface of the door and has locked and unlocked positions. The key controlled lock is spacedly disposed from the locking member and adapted for engaging, inside the door, with the free end of the latch plate. The key controlled lock, in its locked position, engages with the latch plate to prevent rotation of the rotatable knob, and in its unlocked position, disengages from the latch plate to enable rotation of the rotatable knob from its locked position to its unlocked position.

In accordance with still further aspects of the present invention the locking member may include a transverse leg that interconnects the locking bar and the latch plate; the latch plate may extend from the leg and has its free end in alignment with the axis of the key controlled lock; the latch plate free end may have a hole that receives a plunger of the key controlled lock when the key controlled lock is in its locked position and the key controlled lock may include a housing having the plunger extending therefrom in the locked position and having the plunger withdrawn from the latch plate hole in the unlocked position.

BRIEF DESCRIPTION OF THE DRAWINGS

Numerous other objects, features and advantages of the present invention will now become apparent upon a reading of the following detailed description taken in conjunction with the accompanying drawings, in which.

DETAILED DESCRIPTION

Figure 1:
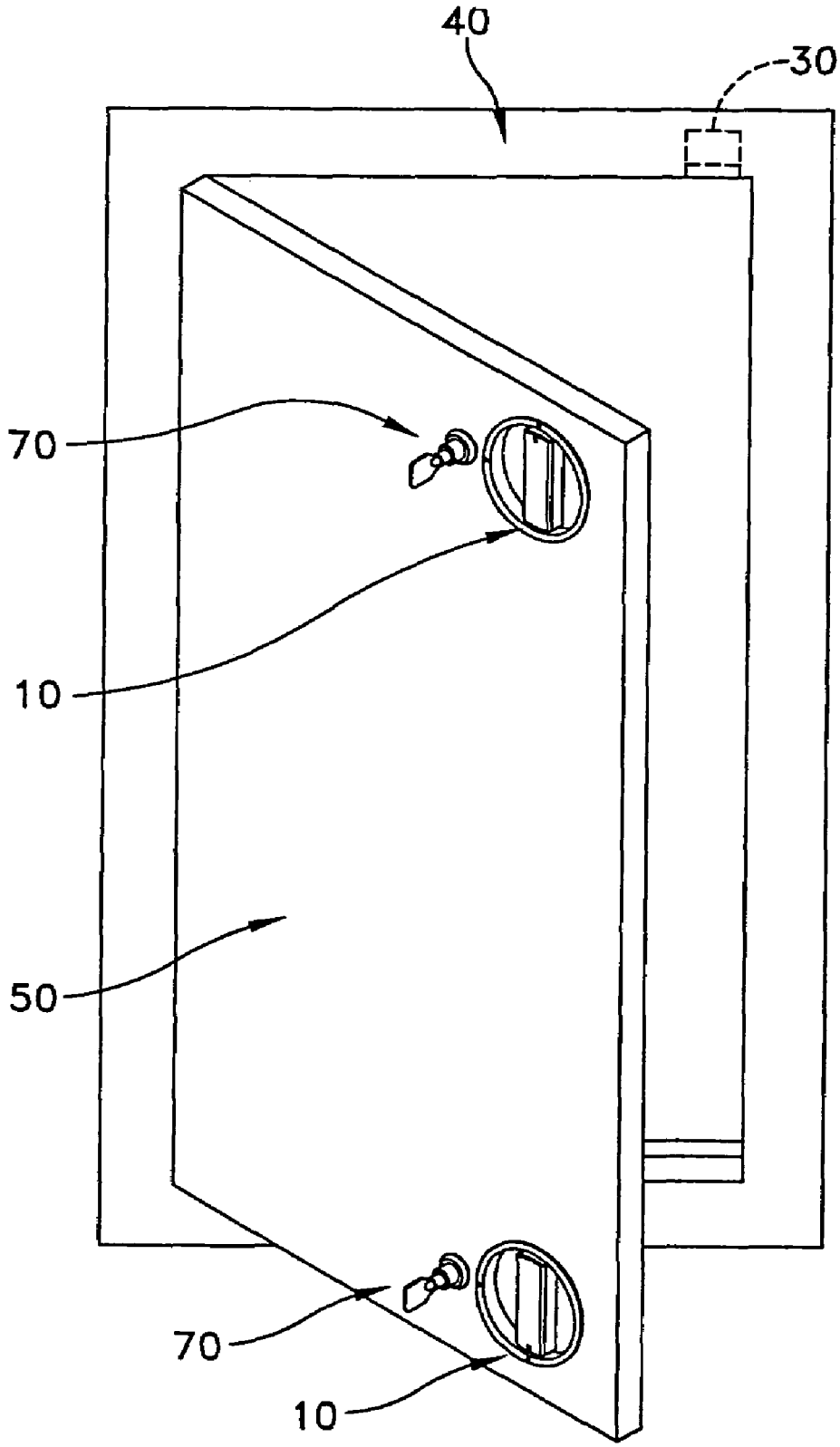
FIG. 1 is a perspective view showing the security lock of the present invention as used on a swingable door.

This invention relates to a locking assembly for a security housing that is adapted to receive and protect valuable electronic equipment, such as computers or the like. The product to be protected is located inside the housing or cabinet that may, in turn, be bolted or otherwise secured to a desk, floor or other supporting surface. The housing or cabinet has a hinged door 50 which when swung to its open position permits access to the computer or the like. The door has key-operated locking means that permit the door to be either locked or opened when desired. The present invention relates to an improved locking assembly that is illustrated in FIGS. 1-14. In the drawings it is noted that two such locking assemblies are disclosed, however, the invention can be readily practiced with only a single locking assembly at either the top, bottom or sides of the door. Also, the lock assembly of the present invention can be used with a wide variety of cabinets or housings and with different types of doors, panels or closures.

Figure 9:
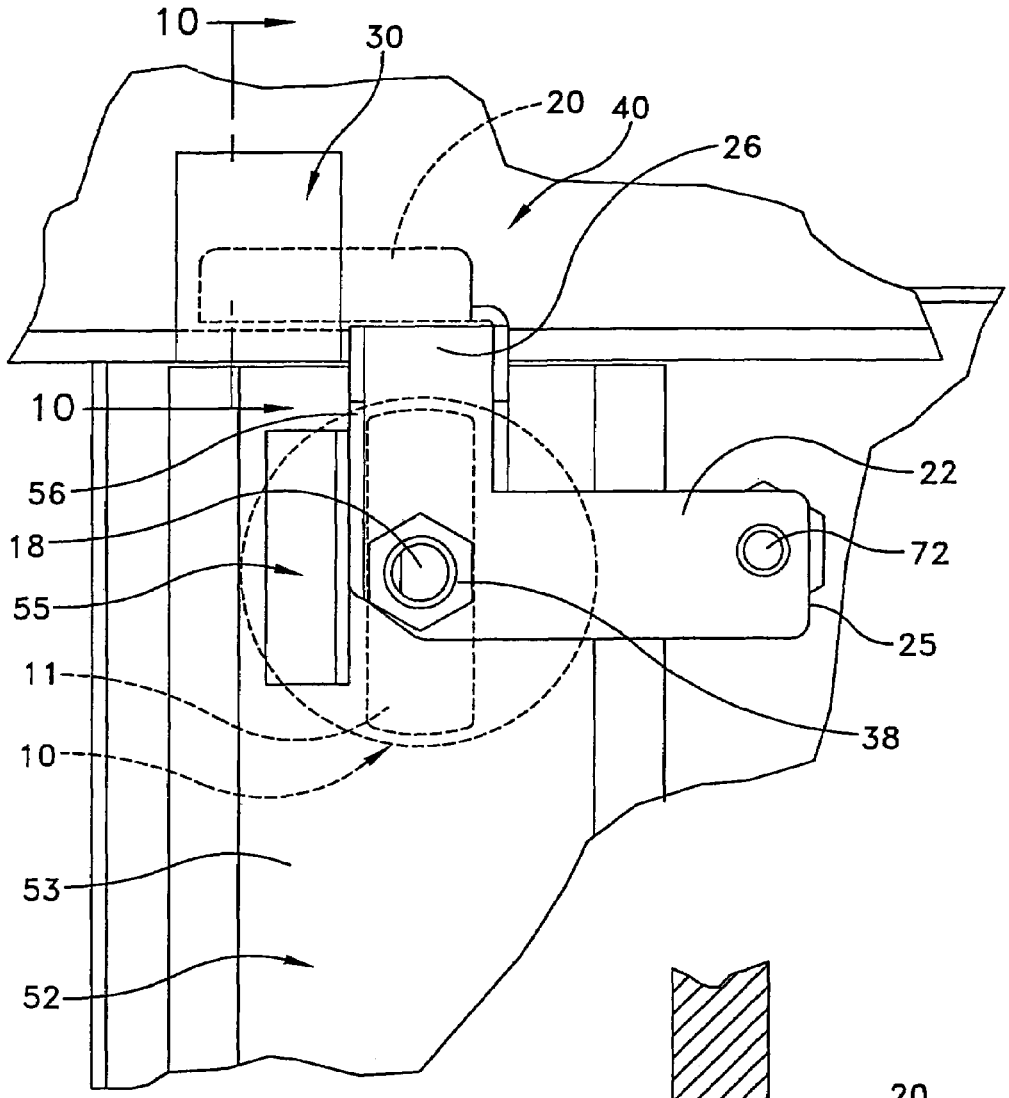
FIG. 9 is a fragmentary rear view of the lock assembly illustrating how it engages with the cabinet.

The present invention, in one embodiment thereof illustrated herein, comprises a rotatable knob 10 that has a locking bar means in the form of a locking member 20 connected to the back surface thereof, which locking member is adapted to interengage with a fixed structure, such a striker plate 30 illustrated in FIGS. 1 and 9, within a housing or cabinet 40, and that prevents the door 50 from being swung to its open position. A latch plate 22, integral with the locking member 20, is also secured to the back of the rotary knob 10 so as to rotate therewith. The latch plate has an aperture 24 therein adjacent its free end 25. A key-controlled spring-loaded lock 70 is operable from the front of the cabinet to a position wherein the plunger 72 thereof extends through the aperture 24 in the latch plate 22, thus preventing rotation of the handle or knob 10. In the position illustrated in FIGS. 2-5, the cabinet remains locked, and the door cannot be opened. When the key is operated to release the lock, a spring biasing means (not shown) automatically causes the plunger 72 to retract from the aperture 24 in the latch plate 22, thus permitting rotation of the latch plate 22 and the knob 10 as well as the locking member 20. The locking member 20 and latch plate 22 rotate as a unit, which rotation permits disengagement of the locking member with the fixed structure attached to the cabinet 40 so that now the security door 50 is free to be swung to its open position.

The key-controlled lock 70 is disposed, in FIG. 1, just to the left of the rotary knob 10. This lock 70 could also be disposed on other sides of the knob 10 and is preferably located adjacent to but spaced from the knob 10. The lock 70 has a spring-loaded plunger 72 that may be pushed inwardly, after which the key may be turned to maintain the plunger in its inward position, and then the key can be removed. The lock 70 itself may be of conventional design and can use various types of locking mechanisms, any one of which will provide a plunger arrangement adapted to move into and out of the aperture 24 in the latch plate 22. As indicated previously when the key-controlled plunger is in its locked position, the plunger pin extends through the adjacent hole in the latch plate, so it is now not possible to rotatably move the knob 10. However, once the locking plunger has been unlocked by manipulation of the key, the plunger moves by spring bias to its inner or unlocked position, i.e., it is no longer extending through the aperture 24 in the latch plate 22, thus permitting rotary movement of the knob 10, the latch plate 22, and the locking member 20, all of which rotate as a unit. In the particular embodiment described herein there is ninety degrees counterclockwise rotation of the knob 10 to swing the locking member to a disengaged position wherein the door is no longer maintained in its locked position and can be swung to its open position. However, the knob can rotate through other angles between locked and unlocked positions.

Figure 2:
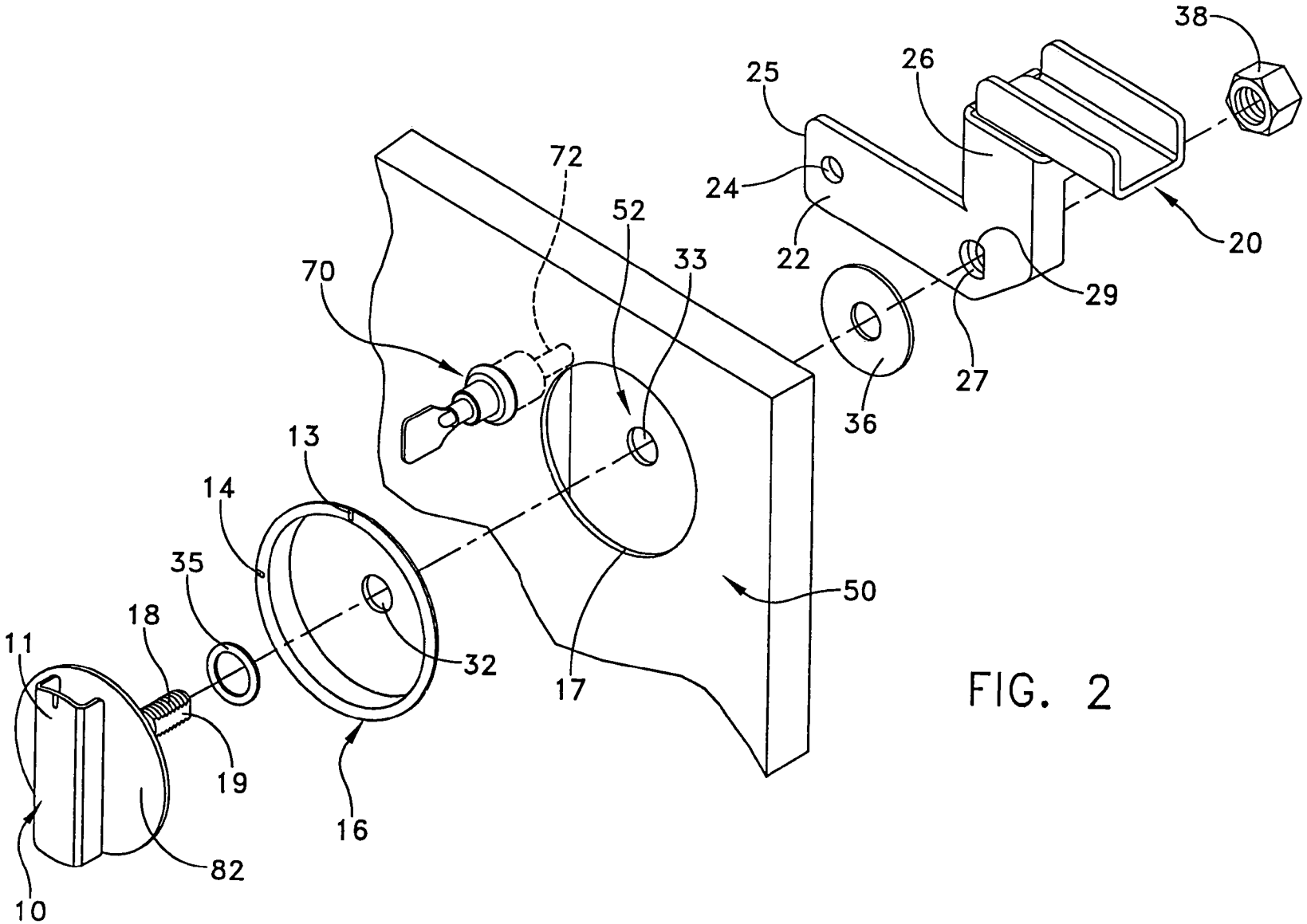
FIG. 2 is a fragmentary exploded view of the components comprising the security lock assembly.
Figure 3:
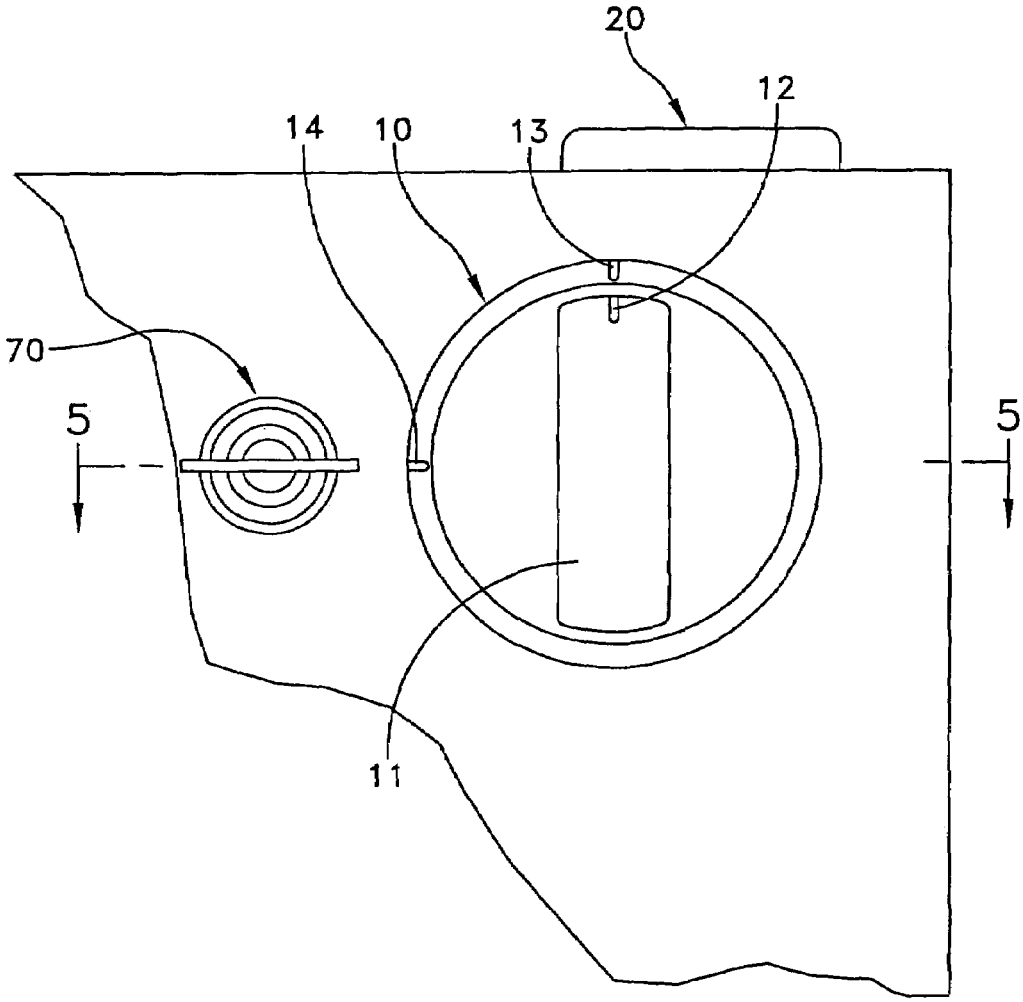
FIG. 3 is a fragmentary front view showing the rotation knob in its locked position.

With further reference to the drawings, and in particular FIG. 2, the rotation knob 10 includes a handle 11 that is used to grasp the knob and rotate it between basically two separate positions that are disposed 90 degrees, one to the other. These different positions are illustrated in FIG. 3 in which the handle 11 with its marker 12 either aligns with the fixed position marker 13 or the fixed position marker 14. In FIG. 3 the handle 11 of the knob 10 is shown in its upright position in which the markers 12 and 13 are in alignment. This corresponds to a locked position of the assembly.

The assembly also includes a dished member 16 that carries the markers 13 and 14 and that is adapted to fit within a hole 17 in the door 50. FIG. 2 also shows the locking member 20 which is integrally formed with the latch plate 22. The locking member 20 and the latch plate 22 are interconnected by a transverse leg 26. As noted in FIG. 2, the locking member 20 has a U-shaped cross section. This unitary piece is also provided with a hole 27 through which the threaded shaft 18 on the knob 10 extends. It is noted that the hole 27 is partially circular and has a flat portion 29 that mates with a flat 19 on the threaded shaft 18. The threaded shaft 18 also extends through the hole 32 in the dish member 16 and the hole 33 in the channel member 52. A washer 35 is provided between the knob 10 and the dished member 16. Also, a washer 36 is provided between the locking member 20 and the channel member. A nut 38 is secured to the threaded shaft 18. The threaded shaft is part of a bolt that is secured with its head 80 welded within the handle 11.

Figure 4:
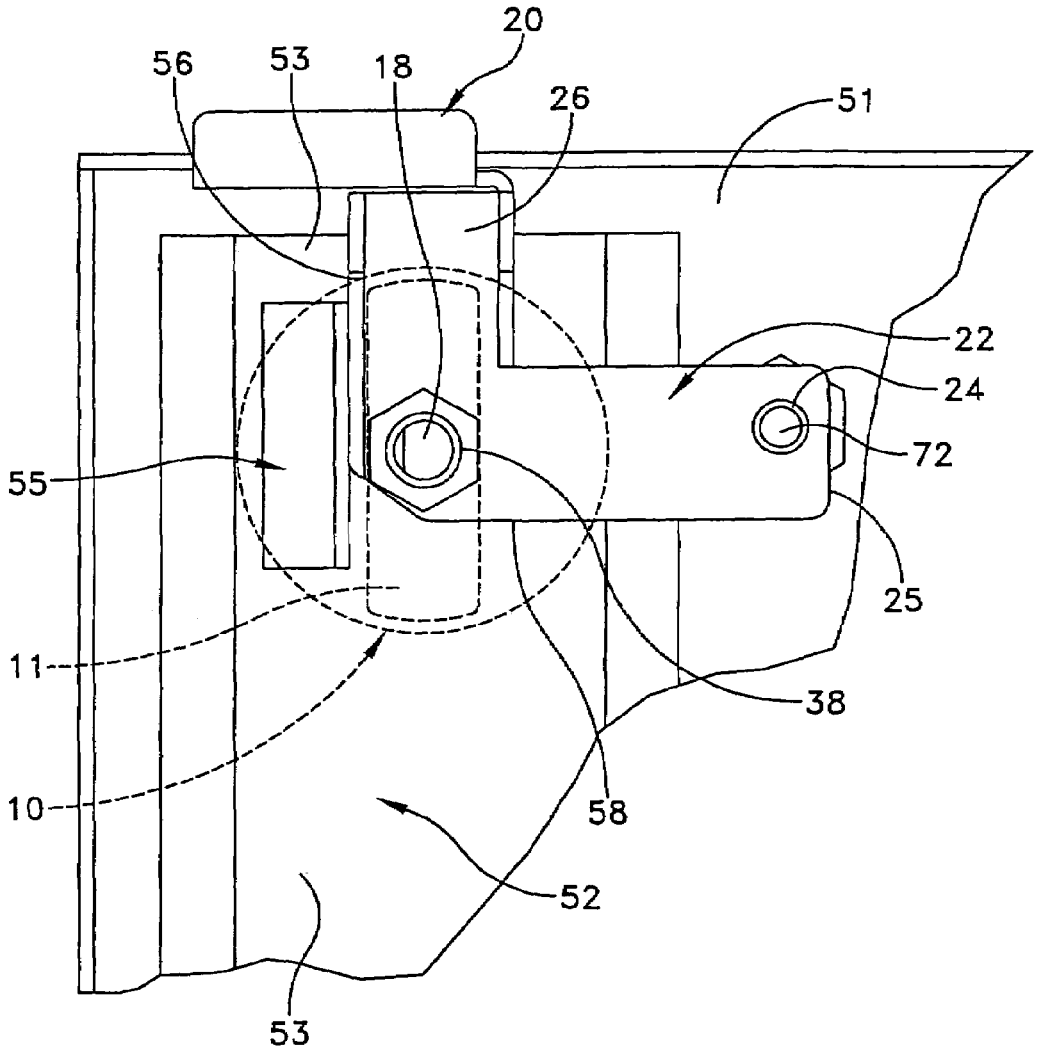
FIG. 4 is a fragmentary rear view of the security lock with the rotation knob in its locked position.
Figure 5:
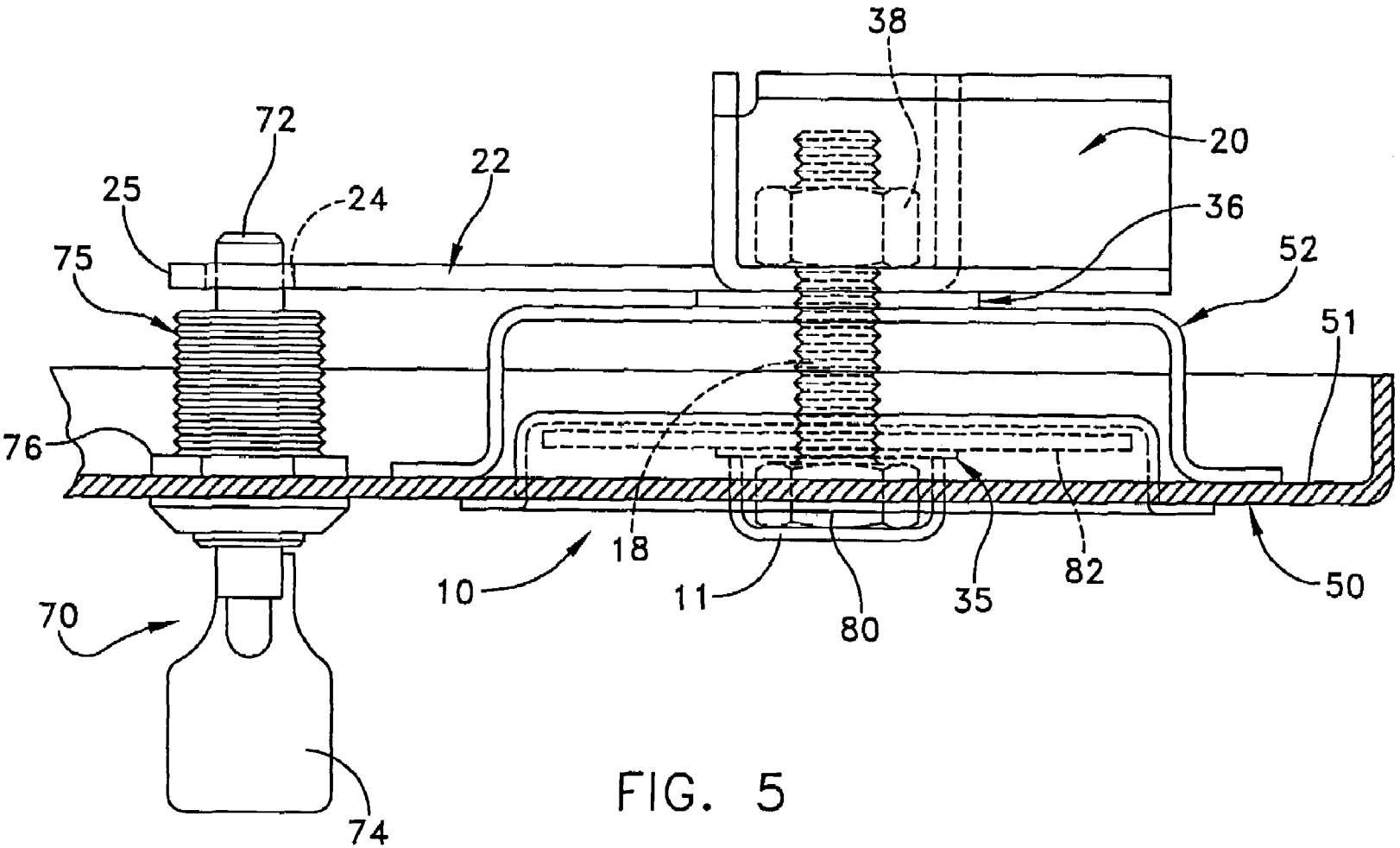
FIG. 5 is a cross-sectional view as taken along line 5-5 of FIG. 3.
Figure 6:
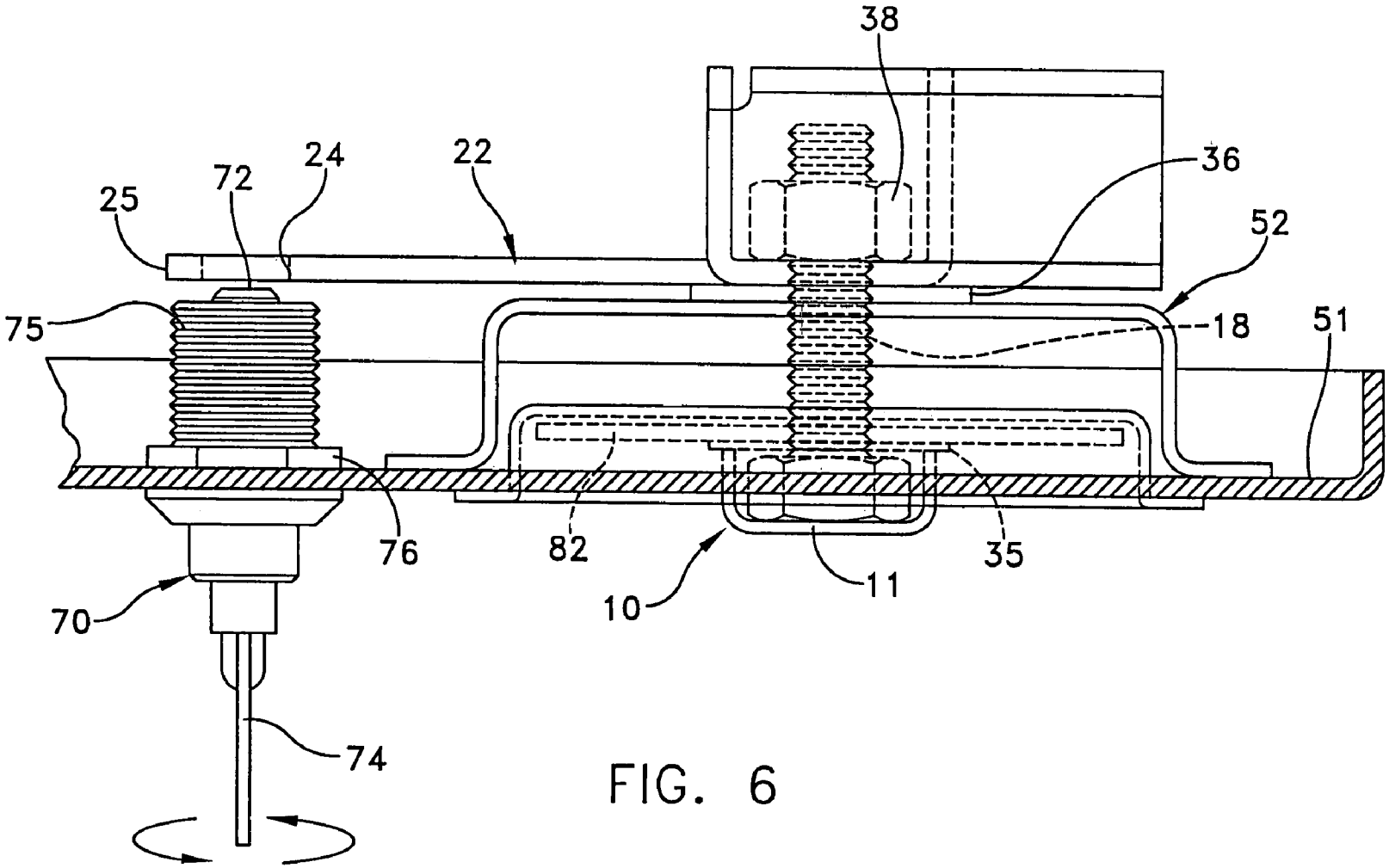
FIG. 6 is a cross-sectional view similar to that illustrated in FIG. 5 but showing the lock in its unlocked position.
Figure 7:
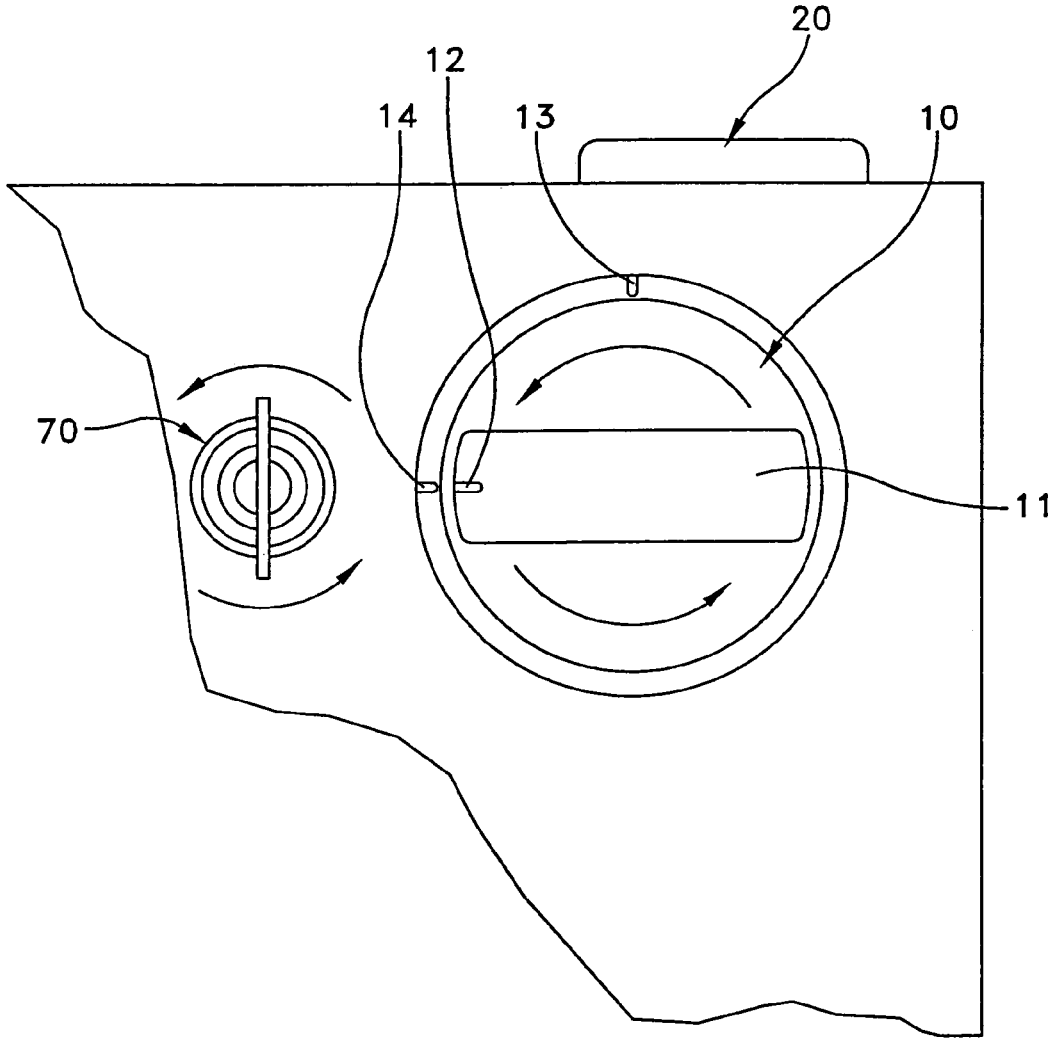
FIG. 7 is a fragmentary front view like that shown in FIG. 3 but with the rotation knob moved to its unlocked position and with the key in its unlocked position.
Figure 8:
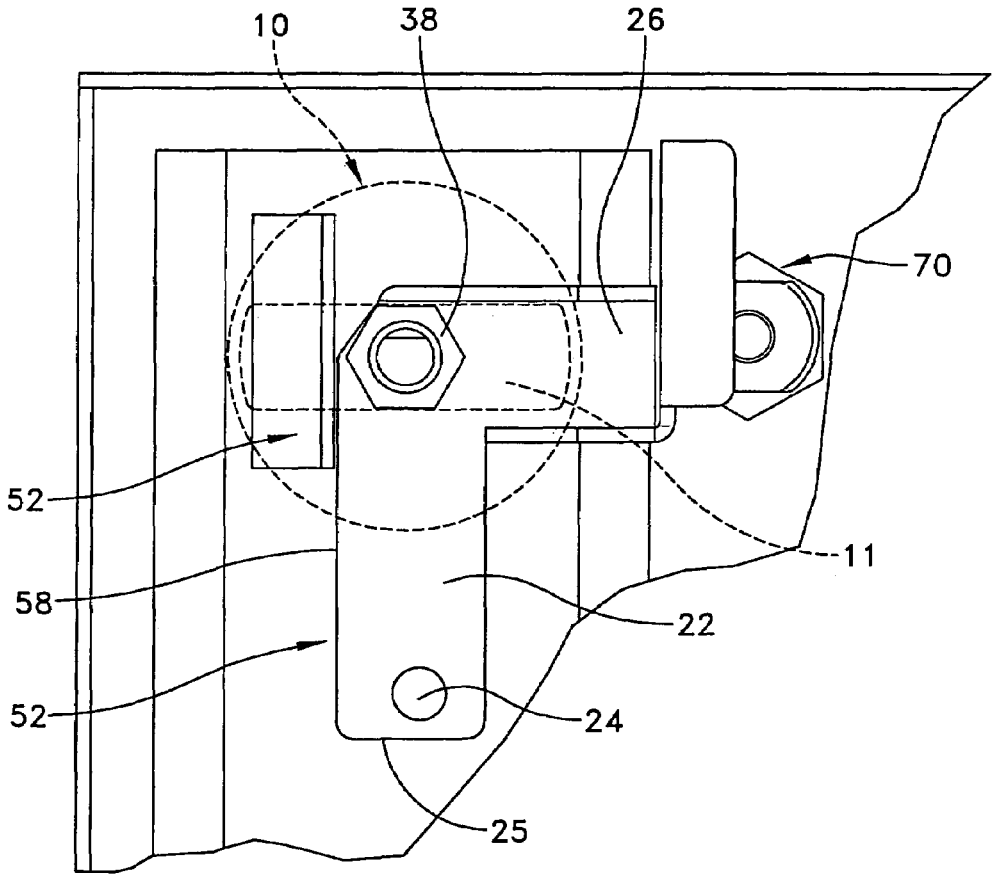
FIG. 8 is a fragmentary rear view of the lock assembly in its unlocked position.

Reference is now made to FIG. 4 for an illustration of further details of the locking assembly. On the rear surface 51 of the door 50, there is secured a channel member 52. Refer also to the cross-sectional view of FIG. 5 for an illustration of the cross-sectional shape of the channel member 52. The channel member 52 may be secured to the inner surface 51 of the door 50 by means of a tack welding or other appropriate means. The channel member 52, along with the door 50, provide means for support of the locking assembly. On the back surface 53 of a main section of the channel member 52, there is secured an L-shaped stop 55. Side legs extend from the main section to be fixed to the door as seen in FIG. 5. In FIG. 4 the wall 56 of the leg 26 is shown urged against the stop 55. This occurs in the locked position of the assembly. In the open position of the assembly, as depicted in FIG. 8, then the side 58 of the latch plate 20 engages the stop 55. Thus, by using the latch plate and leg arrangement in which the two members are disposed substantially at 90 degrees to each other, one can assure that the lock assembly moves only between two opposite 90 degree positions. See also FIG. 7 in which the rotation knob is in the other 90 degree position as compared to the position of FIG. 3.

The cross-sectional view of FIG. 5 depicts the locking assembly in its locked position in which the plunger 72 is disposed within the aperture 24. This secures the knob 10 in the position depicted in FIG. 3. The key-controlled lock 70, as indicated previously, may be of conventional design and includes a key 74 that may be rotated such as depicted in FIG. 7. The lock 70 extends through a hole in the face of the door and has a threaded end 75. A nut 76 is used, threaded onto the threaded end 75 for securing the lock 70 in place.

FIG. 5 also shows further details of the knob construction. The threaded shaft 18, previously identified, may be formed by a bolt having its head 80 disposed within the U-shaped handle 11. The bolt head 80 may be secured in place by being welded within the handle 11. A circular disk 82 is seated within the dished member 16. The washer 35 is disposed between the handle 11 and the disk 82. Similarly, the washer 36 is disposed between the channel member 52 and the locking means. Both the washers 35 and 36 may be of a plastic material including teflon and form a bushing effect that readily enables rotation of the knob 10. The threaded shaft 18 engages with the nut 38 and when the knob is rotated the entire assembly including the threaded shaft, nut and locking means are rotated as a unit therewith. The washers 35 and 36 are frictionally maintained as non-rotating.

Figure 10:
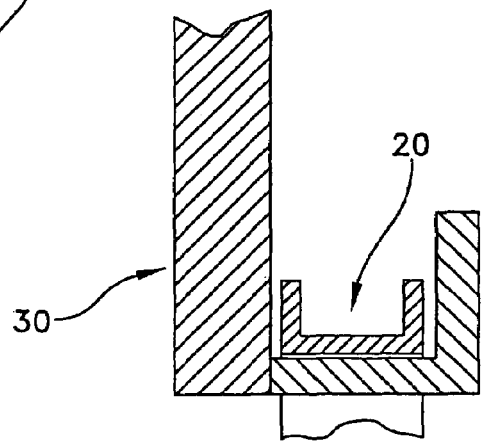
FIG. 10 is a cross-sectional view taken along line 10-10 of FIG. 9.
Figure 11:
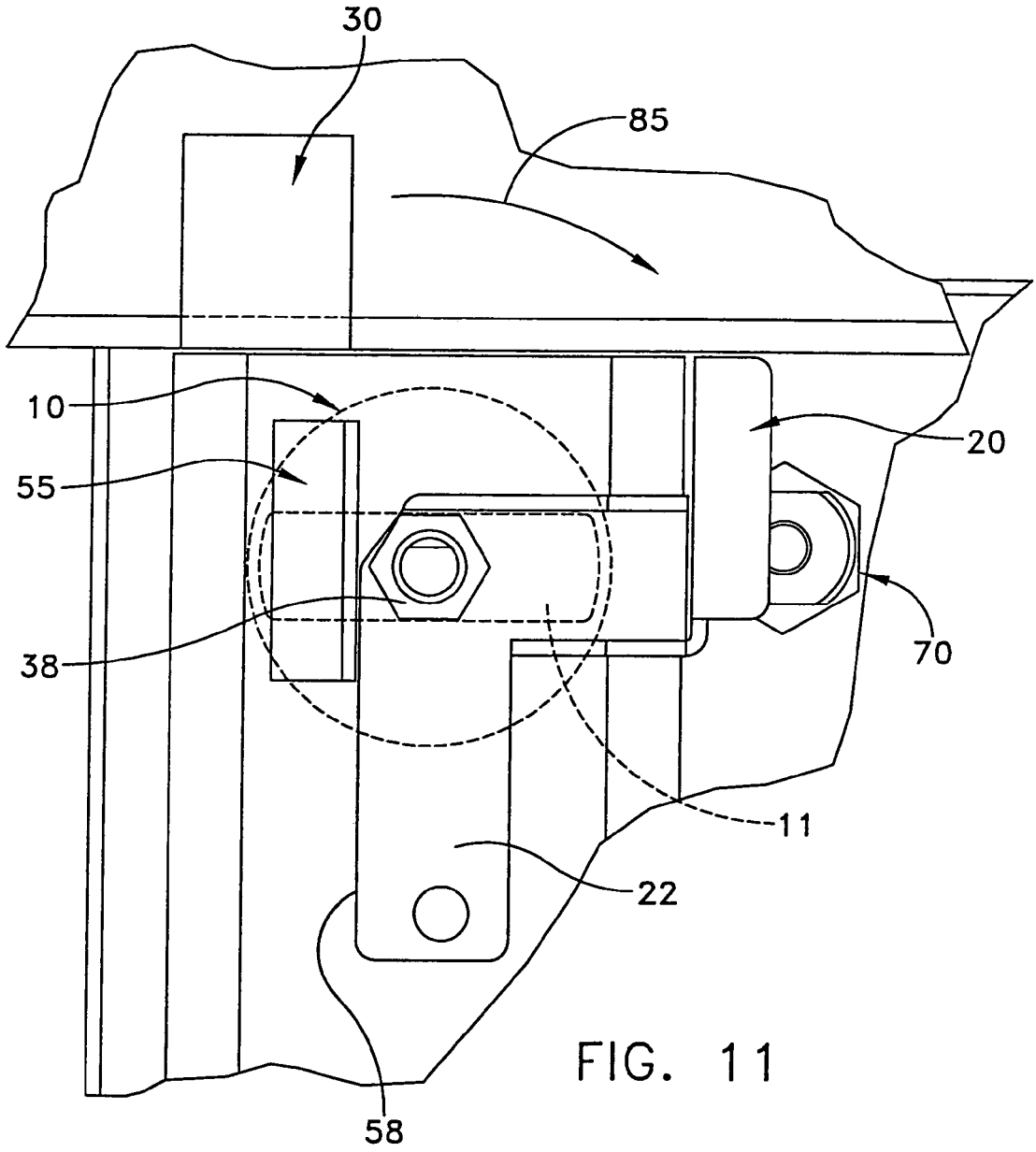
FIG. 11 is a fragmentary rear view of the lock assembly in its unlocked position.
Figure 13:
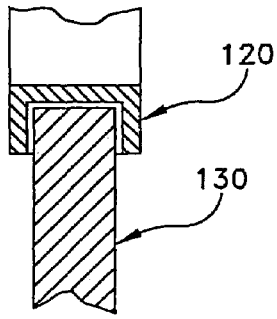
FIG. 13 is a cross-sectional view taken along line 13-13 of FIG. 12.

Reference is now made to FIGS. 9-11 for an illustration of the fixed cabinetry structure that includes a striker plate 30 that is adapted for engagement with the locking member 20. Various forms of plates may be used. Two different versions are illustrated in FIGS. 10 and 13. FIGS. 9 and 10 illustrate the locking member in its locked position engaging with the striker plate 30. The cross-sectional view of FIG. 10 illustrates the construction of the striker plate 30 and the manner in which the locking member 20 engages into a channel in the striker plate. FIG. 11 shows the locking assembly in its open position with the key-controlled lock 70 having been disengaged enabling the rotation of the knob 10 in the direction of the arrow 85 to the position illustrated in FIG. 11. In that position, the stop 55 which is urged against the surface 58 limits the knob to this position. The locking member 20 is out of engagement with the striker plate 30. In that position the door is free to be opened. In FIG. 11 it is also noted that the locking member 20 is sufficiently clear of the door opening so that the door can be swung open.

Figure 12:
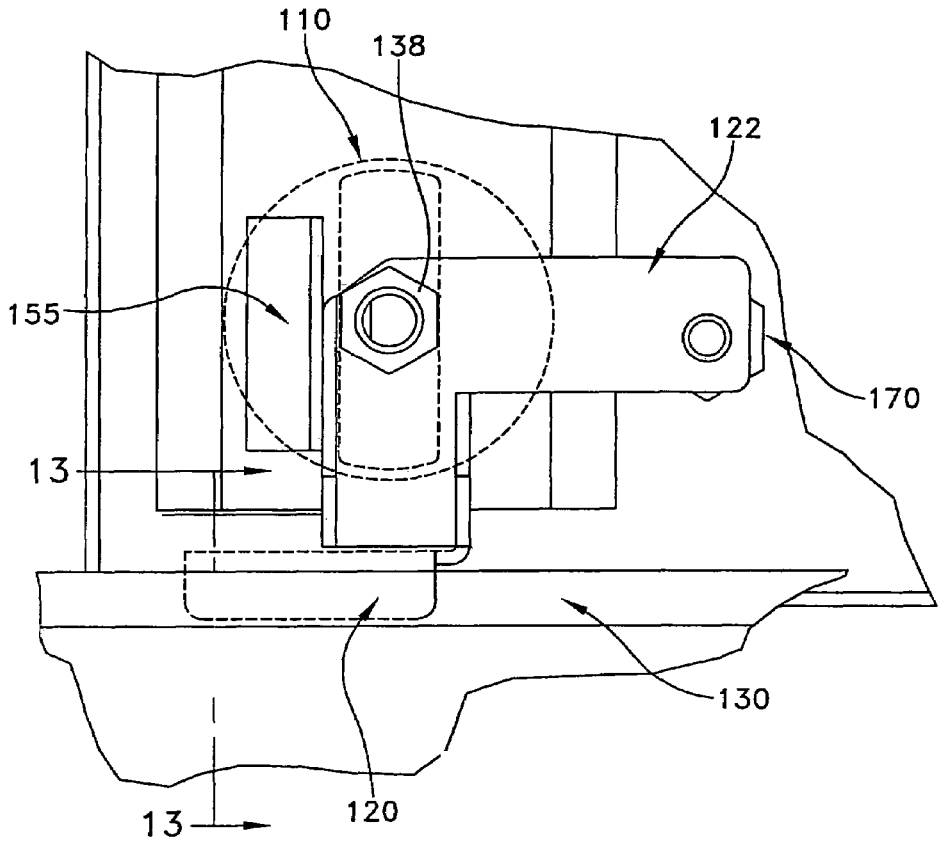
FIG. 12 is a fragmentary rear view illustrating the lower disposed locking assembly in its lock position.
Figure 14:
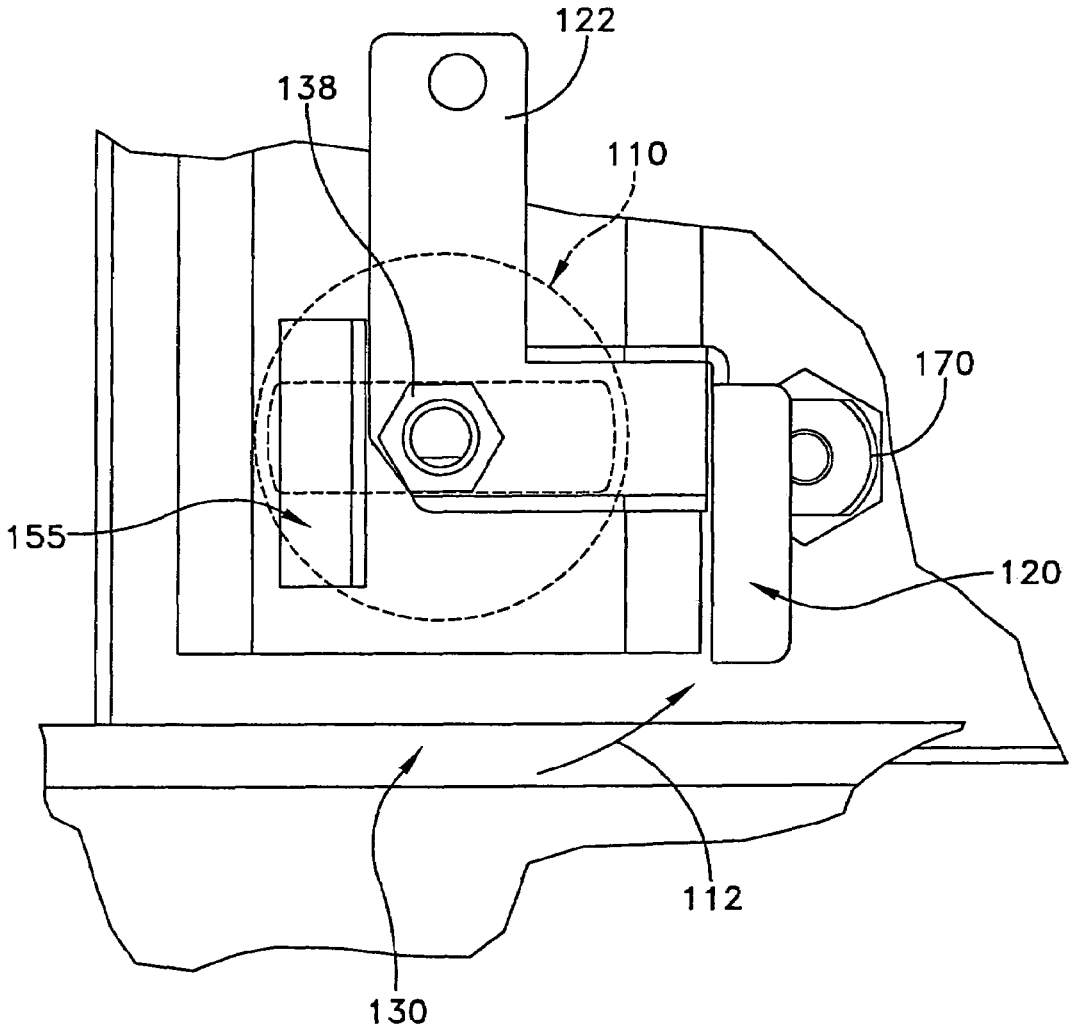
FIG. 14 is a fragmentary rear view of the lock assembly of FIG. 13 in its unlocked position.

Reference is now made to FIGS. 12-14 for an illustration of the locking assembly as used at the bottom of the door rather than at the top. All of the components illustrated in FIGS. 12-14 are substantially the same as previously illustrated in FIGS. 1-11. This includes the use of a rotation knob 110, locking member 122, and a key-controlled lock 170. FIG. 12 shows the assembly in its locked position in which the plunger of the lock 170 engages the aperture in the latch plate 122. In that position the locking member 120 is secured by means of the striker plate 130. This prevents the door from being opened. FIG. 14 illustrates the assembly in its open position in which the key-controlled lock 170 has been disengaged and the knob 110 has been rotated in the direction of arrow 112 so that the locking member 120 is disengaged from the striker plate 130.

Having now described a limited number of embodiments of the present invention, it should be apparent to those skilled in the art that numerous other embodiments and modifications thereof are contemplated as falling within the scope of the present invention, as defined by the appended claims.

What is claimed is:

1. A locking device, comprising:

a door to be secured;

a rotatable knob adapted for mounting at a front surface of the door and having locked and unlocked positions;

a locking member adapted for positioning at an opposite rear surface of the door and in alignment with said rotatable knob;

said locking member further including a latch plate integral therewith;

means for securing the rotatable knob to the locking member through the door; and a key-controlled lock supported at the front surface of the door and having locked and unlocked positions;

said latch plate being supported for rotation between locked and unlocked positions and controlled from said rotatable knob;

said key-controlled lock being spacedly disposed from said locking member and adapted for engaging, inside the door, with said latch plate;

said key-controlled lock, in its locked position, engaging with said latch plate to prevent rotation of said rotatable knob, and in its unlocked position, disengaging from said latch plate to enable rotation of said rotatable knob from its locked position to its unlocked position;

wherein the locking member includes a locking bar and a transverse leg that interconnects the locking bar and the latch plate;

wherein said latch plate extends from said leg and has a free end that is in alignment with said key-controlled lock;

wherein the latch plate free end has a hole that receives a plunger of the key-controlled lock when the key-controlled lock is in its locked position;

wherein the key-controlled lock includes a housing having the plunger extending therefrom in the locked position and having the plunger withdrawn from the latch plate hole in the unlocked position so as to enable the latch plate to be rotated;

and wherein said locking bar, transverse leg and latch plate are all integrally formed and all rotate in substantially the same plane and substantially in parallel to the plane of the door.

2. The locking device of claim 1 wherein said means for securing the rotatable knob to the locking member includes a threaded shaft on the knob engaging with a hole in the locking member.

3. The locking device of claim 2 wherein the threaded shaft and the hole have like non-circular cross-sections and a nut secures the threaded shaft with the locking member.

4. The locking device of claim 1 including a channel member mounted on the back of the door, having a U-shape, including side legs fixed to the back of the door and a main section that supports the rotatable knob.

5. The locking device of claim 4 including a stop secured to the main section of the channel member, the transverse leg engaging the stop in the locked position of the latch plate and the latch plate engaging the stop in the unlocked position of the latch plate.

6. The locking device of claim 5 wherein the transverse leg is disposed orthogonal to both the latch plate and locking bar.

7. The locking device of claim 6 wherein said means for securing the rotatable knob to the locking member includes a threaded shaft on the knob engaging with a hole in the locking member, the hole in the locking member includes a non-circular portion and the hole in the locking member is disposed at the connection between the transverse leg and the latch plate so as to form a pivot for the locking member.

8. The locking device of claim 1 wherein the locking bar is U-shaped and is adapted to engage a striker plate adjacent the door.

9. The locking device of claim 1 wherein the rotatable knob, locking member and key-controlled lock are all disposed at a top area of the door and further including a second rotatable knob, second locking member and second key-controlled lock at a bottom area of the door.

10. A locking assembly comprising:

a door to be secured;

a rotatable knob;

means for mounting the rotatable knob at a front surface of the door;

said rotatable knob having locked and unlocked positions;

a locking member;

means for positioning the locking member at an opposite rear surface of the door and in alignment with said rotatable knob;

said locking member further including a locking bar, a transverse leg and a latch plate;

said locking bar, transverse leg and latch plate are all integrally formed;

means for securing the rotatable knob to the locking member through the door; and a key-controlled lock supported at the front surface of the door and having locked and unlocked positions;

said latch plate being supported for rotation between locked and unlocked positions and controlled from said rotatable knob;

said transverse leg extending radially from said latch bar so that a free end of said latch plate is in alignment with said key-controlled lock;

said key-controlled lock being spacedly disposed from said rotatable knob and adapted for engaging, inside the door, with the free end of said latch plate;

said key-controlled lock, in its locked position, engaging with said latch plate to prevent rotation of said rotatable knob, and in its unlocked position, disengaging from said latch plate to enable rotation of said rotatable knob from its locked position to its unlocked position;

wherein said latch plate extends substantially orthogonal from said leg and has said free end that is in alignment with said key-controlled lock;

wherein the latch plate free end has a hole that receives a plunger of the key-controlled lock when the key-controlled lock is in its locked position;

including a channel member mounted on the back of the door, having a U-shape, including side legs fixed to the back of the door and a main section that supports the rotatable knob;

said main section for support of said locking member spaced from the back of said door.

11. The locking assembly of claim 10 including a stop secured to the main section of the channel member, the transverse leg engaging the stop in the locked position of the latch plate and the latch plate engaging the stop in the unlocked position of the latch plate;

and wherein said locking bar, transverse leg and latch plate all rotate in substantially the same plane and substantially in parallel to the plane of the door.

12. The locking assembly of claim 11 wherein said means for securing the rotatable knob to the locking member includes a threaded shaft on the knob engaging with a hole in the locking member, the threaded shaft and the hole have like non-circular cross-sections and a nut secures the threaded shaft with the locking member.

13. The locking assembly of claim 11 wherein the key-controlled lock includes a housing having the plunger extending therefrom in the locked position and having the plunger withdrawn from the latch plate hole in the unlocked position.

14. The locking assembly of claim 12 wherein said means for securing the rotatable knob to the locking member includes a threaded shaft on the knob engaging with a hole in the locking member, the hole in the locking member includes a non-circular portion and the hole in the locking member is disposed at the connection between the transverse leg and the latch plate so as to form a pivot for the locking member.

15. The locking assembly of claim 10 wherein the rotatable knob, locking member and key-controlled lock are all disposed at a top area of the door and further including a second rotatable knob, second locking member and second key-controlled lock at a bottom area of the door.

16. A locking device comprising:

a door to be secured;

a rotatable knob adapted for mounting at a front surface of the door and having locked and unlocked positions;

a locking member adapted for positioning at an opposite rear surface of the door and in alignment with said rotatable knob;

said locking member comprised of a locking bar, a transverse leg and an integral latch plate having a free end;

said locking bar adapted for engagement with a door striker in the locked position;

said rotatable knob being coupled to the locking member through the door; and a key-controlled lock supported at the front surface of the door and having locked and unlocked positions;

said latch plate being supported for rotation between locked and unlocked positions and controlled from said rotatable knob;

said key-controlled lock being spacedly disposed from said locking member and adapted for engaging, inside the door, with the free end of said latch plate;

said key-controlled lock, in its locked position, engaging with said latch plate to prevent rotation of said rotatable knob, and in its unlocked position, disengaging from said latch plate to enable rotation of said rotatable knob from its locked position to its unlocked position;

wherein said latch plate extends substantially orthogonal from said transverse leg and has a free end that is in alignment with said key-controlled lock;

wherein the latch plate free end has a hole that receives a plunger of the key-controlled lock when the key-controlled lock is in its locked position;

including a channel member mounted on the back of the door, having a U-shape, including side legs fixed to the back of the door and a main section that supports the rotatable knob;

said main section for support of said locking member spaced from the back of said door; including a stop secured to the main section of the channel member, the transverse leg engaging the stop in the locked position of the latch plate and the latch plate engaging the stop in the unlocked position of the latch plate.

17. The locking device of claim 16 wherein the locking member has the transverse leg that extends at a right angle to both the locking bar and the latch plate and wherein said locking bar, transverse leg and latch plate all rotate in substantially the same plane and substantially in parallel to the plane of the door.

18. The locking device of claim 17 wherein means for securing the rotatable knob to the locking member includes a threaded shaft on the knob engaging with a hole in the locking member, the hole in the locking member includes a non-circular portion and the hole in the locking member is disposed at the connection between the transverse leg and the latch plate so as to form a pivot for the locking member.

19. The locking device of claim 18 wherein the stop is disposed adjacent to the locking member.

20. The locking device of claim 19 wherein the key-controlled lock includes a housing having the plunger extending therefrom in the locked position and having the plunger withdrawn from the latch plate hole in the unlocked position.

21. A locking device for securing a cabinet door in a locked position, comprising:

a door to be secured;

a rotatable knob adapted for mounting at a front surface of the door and having locked and unlocked positions;

a locking member adapted for positioning at an opposite rear surface of the door and in alignment with said rotatable knob;

said locking member comprised of a locking bar, a transverse leg and an integral latch plate having a free end;

said locking bar, transverse leg and latch plate extending for rotation in substantially the same plane that is substantially parallel to the plane of the door;

said locking bar adapted for engagement with a door striker in the locked position;

said rotatable knob having a knob shaft coupled to the locking member through the door;

a key-controlled lock supported at the front surface of the door and having locked and unlocked positions;

said latch plate being supported for rotation between locked and unlocked positions and controlled from said rotatable knob;

said key-controlled lock being spacedly disposed from said locking member and adapted for engaging, inside the door, with the free end of said latch plate;

said key-controlled lock, in its locked position, engaging with said latch plate to prevent rotation of said rotatable knob, and in its unlocked position, disengaging from said latch plate to enable rotation of said rotatable knob from its locked position to its unlocked position;

wherein said latch plate extends at a right angle from said transverse leg and has said free end that is in alignment with said key-controlled lock;

wherein the transverse leg also extends at a right angle to the locking bar;

wherein the latch plate free end has a hole that receives a plunger of the key-controlled lock when the key-controlled lock is in its locked position;

a channel member mounted on the back of the door, having a U-shape, including side legs fixed to the back of the door and a main section that supports the rotatable knob shaft;

said channel member being disposed between the door and locking member;

said main section for support of said locking member spaced from the back of said door; and a stop secured to the main section of the channel member, the transverse leg engaging the stop in the locked position of the latch plate and the latch plate engaging the stop in the unlocked position of the latch plate.

* * * * *

UNITED STATES PATENT AND TRADEMARK OFFICE

CERTIFICATE OF CORRECTION

PATENT NO. : 7,360,381 B1
APPLICATION NO. : 11/226147
DATED : April 22, 2008
INVENTOR(S) : Paul Leite It is certified that error appears in the above-identified patent and that said Letters Patent is hereby corrected as shown below:

Column 1, line 14, after “as a” insert --door or--.

Column 8, line 4, delete “transverse leg” and insert --latch plate--.

Column 8, line 4, delete “latch bar” and insert --transverse leg--.

Signed and Sealed this

Twenty-sixth Day of August, 2008

JON W. DUDAS
*Director of the United States Patent and Trademark Office*